US011395511B2

(12) United States Patent
Lozier et al.

(10) Patent No.: US 11,395,511 B2
(45) Date of Patent: Jul. 26, 2022

(54) SMOKING STENT FOR CIGAR OR FILTERLESS CIGARETTE

(71) Applicant: Smooth Cigar Flow, LLC, Hamilton Square, NJ (US)

(72) Inventors: James Lozier, Hamilton Square, NJ (US); Daniel Bonilla, Bristol, PA (US)

(73) Assignee: Smooth Cigar Flow, LLC, Hamilton Square, NJ (US)

( * ) Notice: Subject to any disclaimer, the term of this patent is extended or adjusted under 35 U.S.C. 154(b) by 487 days.

(21) Appl. No.: 16/233,976

(22) Filed: Dec. 27, 2018

(65) Prior Publication Data

US 2019/0343177 A1 Nov. 14, 2019

Related U.S. Application Data

(60) Provisional application No. 62/670,757, filed on May 12, 2018.

(51) Int. Cl.
*A24F 13/08* (2006.01)

(52) U.S. Cl.
CPC ..... *A24F 13/08* (2013.01)

(58) Field of Classification Search
CPC ..... A24F 13/10; A24F 13/18; A24F 13/00; A24F 13/14; A24F 13/06; A24F 13/04; A24F 13/26; A24F 13/22; A24F 13/24; A24F 13/02
See application file for complete search history.

(56) References Cited

U.S. PATENT DOCUMENTS

| | | | | | |
|---|---|---|---|---|---|
| 400,446 | A | | 4/1889 | Dixon | |
| 980,080 | A | * | 12/1910 | Eder | A24F 13/10 131/182 |
| 1,821,159 | A | | 9/1931 | Hughes | |
| 1,859,395 | A | * | 5/1932 | Hughes | A24F 13/08 131/363 |
| 1,883,701 | A | * | 10/1932 | Goldberg | A24F 13/08 131/189 |
| 1,892,429 | A | * | 12/1932 | Frankel | A24D 1/042 131/254 |
| 2,558,127 | A | * | 6/1951 | Downs | A24D 1/042 131/363 |
| 2,585,696 | A | * | 2/1952 | Sobel | A24F 1/00 131/189 |
| 2,869,558 | A | | 1/1959 | Redford | |
| 3,399,681 | A | * | 9/1968 | Lodi | A24F 13/02 131/189 |
| 2017/0332699 | A1 | * | 11/2017 | Kurthy | A24F 13/24 |

* cited by examiner

*Primary Examiner* — Michael H. Wilson
*Assistant Examiner* — Stephanie Lynn Moore
(74) *Attorney, Agent, or Firm* — LaMorte & Associates P.C.

(57) ABSTRACT

A smoking stent that is inserted into a wrapped smoking product to create a smoking assembly. The presence of the stent prevents the end of the wrapped smoking product from losing integrity when made wet by the mouth. The stent device has a tubular body that defines a central conduit. Side openings are disposed along the tubular body that provide access to the central conduit. The stent device is inserted within the mouth end of the wrapped smoking product so that the central conduit of the tubular body extends into the fill. When the wrapped smoking product is lighted, the smoke is drawn out of the wrapped smoking device through the central conduit of the stent device.

10 Claims, 6 Drawing Sheets

SMOKING STENT FOR CIGAR OR FILTERLESS CIGARETTE

RELATED APPLICATIONS

This application claims the benefit of provisional patent application No. 62/670,757, filed May 12, 2018.

BACKGROUND OF THE INVENTION

1. Field Of The Invention

In general, the present invention relates to devices that are inserted into cigars or cigarettes that promote the flow of smoke through the cigar or cigarette and into the mouth.

2. Prior Art Description

When a person smokes a cigar or a filterless cigarette, the end that is held in the mouth often becomes wet. Over time, the moisture transferred from the mouth can cause the end of the cigar or cigarette to lose structural integrity and collapse under the pressure of the lips. This, in turn, inhibits the flow of smoke to the mouth through the cigar or cigarette.

In the prior art, devices have been developed that can prevent the collapse of a cigar or cigarette. The most common is the cigarette holder. Cigarette holders and cigar holders are extensions that support the cigarette or the cigar away from the mouth. Since the cigarette or cigar does not touch the mouth, it never gets wet and the integrity of the cigarette or cigar is never compromised. The problem with cigarette holders and cigar holders is twofold. First, the holder is not in fashion and is, therefore, aesthetically unpleasing. Second, the holder prevents the smoker from directly tasting the tobacco of the cigarette or cigar. This taste is pleasing to many.

Some shortened holders have also been invented that extend only over the tip of the cigarette or cigar. In this manner, they prevent the cigarette or cigar from getting wet without being aesthetically unpleasing. Such prior art holders are exemplified by U.S. Pat. No. 400,446 to Dixon and U.S. Pat. No. 2,869,558 to Redford. These holders may be less noticeable, but they also prevent a smoker from directly tasting the tobacco in his/her mouth.

Other prior art exists that attempts to internally support the structure of a cigarette or cigar. This prior art provides a solid spike that extends into the end of the cigarette or cigar. The presence of the spike provides structural integrity to the end of the cigarette or cigar as it becomes wet. The smoke exits the cigarette or cigar around the spike. Such prior art is exemplified by U.S. Pat. No. 2,558,127 to Downs and U.S. Patent No. 1,821,159 to Hughes. Although such prior art devices enable a smoker to directly taste the tobacco in the mouth, the tobacco can become wet and collapse around the spike. This prevents smoke from being able to pass freely through the cigarette or cigar.

A need therefore exists for a device that can be inserted into the mouth end of a cigar or cigarette that does not prevent the tobacco from entering the mouth, helps maintain structural integrity, and prevents the moistened tobacco in the mouth from inhibiting the flow of smoke. These needs are met by the present invention as described and claimed below.

SUMMARY OF THE INVENTION

The present invention is a smoking stent that is inserted into a wrapped smoking product to create a smoking assembly. The presence of the stent in the wrapped smoking product prevents the end of the wrapped smoking product from losing integrity when made wet by the mouth.

The wrapped smoking product has a fill material held within a wrapper. The stent device has a tubular body with an open first end and an open second end. The tubular body defines a central conduit between the open first end and the open second end. Side openings are disposed along the tubular body that provide access to the central conduit between the open first end and the open second end.

The stent device is inserted within the mouth end of the wrapped smoking product so that the central conduit of the tubular body extends into the smokable fill of the wrapped smoking product. This positions the open second end of the stent device at the mouth end of the wrapped smoking product. When the wrapped smoking product is lighted, the smoke is drawn out of the wrapped smoking device through the central conduit of the stent device.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

The present invention smoking stent device can be configured in many ways and can be adapted for use in many applications. For example, the smoking stent device can be used with a cigar, a filterless cigarette, or any other wrapped smoking product where the end of the product is nothing more than dried leaf rolled in a paper or leaf wrapper. Although the present invention can be sized and configured for many such applications, only a few exemplary embodiments are illustrated and described. The exemplary embodiments are selected in order to set forth some of the best modes contemplated for the invention. The illustrated embodiments, however, are merely exemplary and should not be considered limitations when interpreting the scope of the claims.

Figure 1:
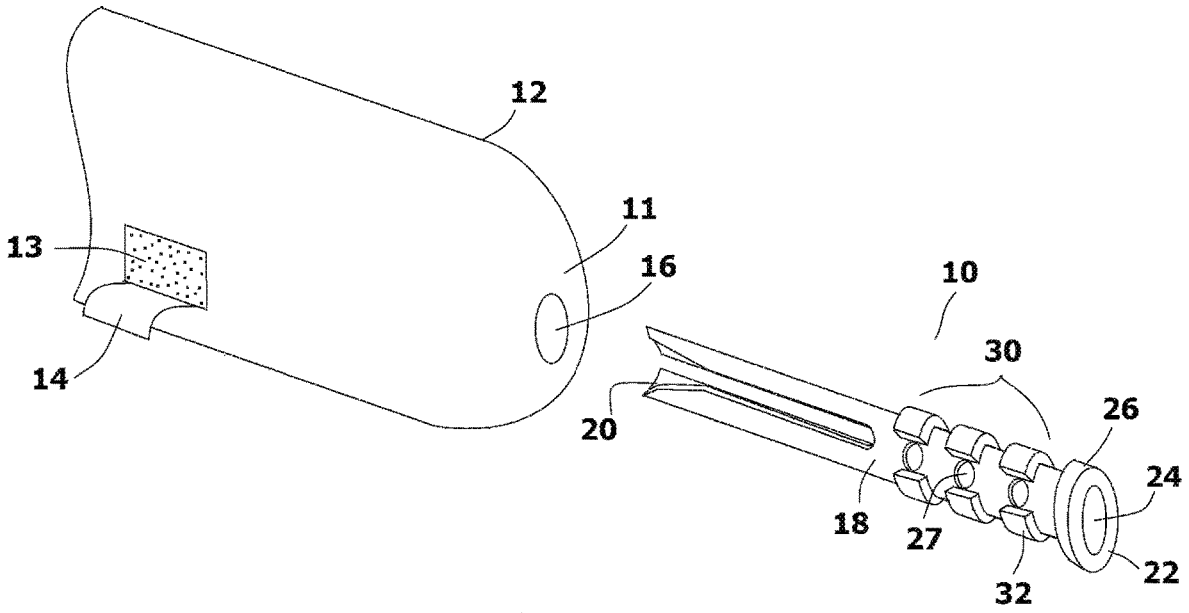
FIG. 1 shows a first exemplary embodiment of a stent device shown in conjunction with a segment of a cigar.
Figure 2:
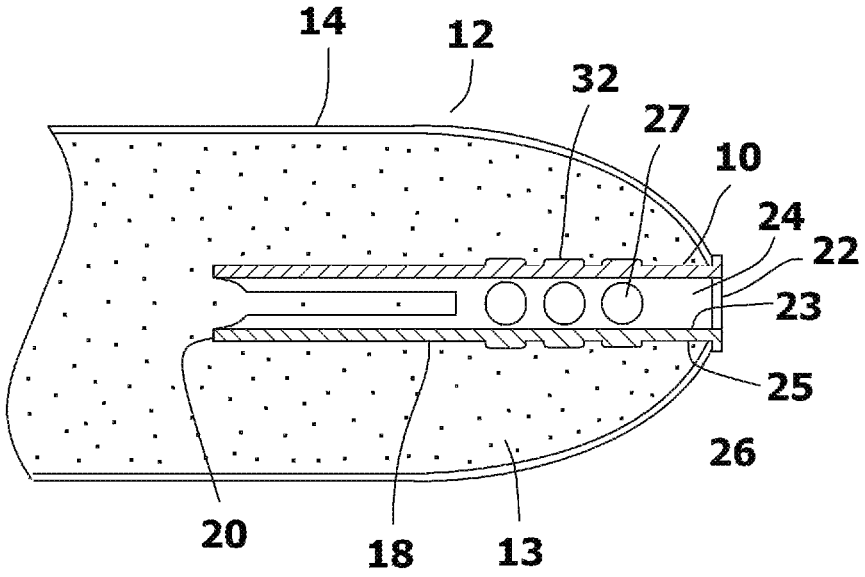
FIG. 2 shows a cross-sectional view of the exemplary embodiment of FIG. 1 shown with the stent device inserted into the cigar.

Referring to FIG. 1, and FIG. 2, a smoking stent device 10 is shown that is sized and shaped to be used in the mouth end of a wrapped smoking product. In the illustrated embodiment, the wrapped smoking product is a cigar 12. However, it will be understood that the wrapped smoking product can be a tobacco cigarette, a cannabis cigarette or any other smoking product containing fill in a wrapper.

In FIG. 1 and FIG. 2, the cigar 12 has a traditional construction where tobacco fill 13 is wrapped in a leaf wrapper 14. When the cigar 12 is prepared for smoking, the leaf wrapper 14 at the mouth end 11 of the cigar 12 is clipped or otherwise pierced. This produces a small opening 16 through which smoke from the cigar 12 can be inhaled.

The smoking stent device 10 has an elongated tubular body 18 that extends from a first end 20 to a second end 22. The primary diameter of the elongated body 18 is such that it can be inserted into the mouth end 11 of the cigar 12 without causing the cigar 12 to rupture or otherwise break. The elongated tubular body 18 has an interior surface 23 and an exterior surface 25. The interior surface 23 defines a central conduit 24 that extends through the elongated tubular body 18 from the first end 20 to the second end 22. The tubular body 18 is perforated or otherwise slotted at various points along its length. This creates smoke flow openings 27 in the peripheral wall that extends between the exterior surface 25 to the interior surface 23. In this manner, smoke can pass through the tubular body 18 from the tobacco fill 13 and into the central conduit 24.

The second end 22 of the tubular body 18 terminates with a flange 26. The first end 20 of the tubular body 18 tapers toward a point to make it easier to pass into the tobacco fill 13 of the cigar 12. The first end 20 of the smoking stent device 10 is inserted into the tobacco fill 13 of the cigar 12 through the small opening 16 that has been previously formed into the cigar 12. The smoking stent device 10 is inserted into the tobacco fill 13 until the flange 26 at the second end 22 contacts the cigar 12. The cigar 12 is then lighted and smoked in the traditional manner. As a person puts the cigar 12 into his/her mouth, the leaf wrapper 14 and the tobacco fill 13 that passes into the mouth can become moist and soft. The presence of the smoking stent device 10 in the mouth end 11 of the cigar 12, ensures that the cigar 12 will not collapse and a pathway will remain open to the smoke until the smoking of the cigar 12 is completed. Smoke passes through the tobacco fill 13 from the point of combustion. The smoke reaches the smoking stent device 10 and passes through the smoke flow openings 27 in the smoking stent device 10. If the end of the cigar 12 is moist, this is often the path of least resistance. The smoke enters the central conduit 24 where it can be inhaled into the mouth. As a result, even if the tobacco fill 13 at the mouth end 11 of the cigar 12 is fully wetted and collapsed, smoke can still freely flow out of the cigar 12 and into the mouth.

To prevent the smoking stent device 10 from being accidentally inhaled with the smoke, the exterior surface 23 of the elongated body 18 can contain some type of anchor system 30. In FIG. 1 and FIG. 2, the anchor system 30 includes some external ridges 32 that roughen the exterior of the smoking stent 10 and resist the removal of the smoking stent 10 from the cigar 12.

Figure 3:
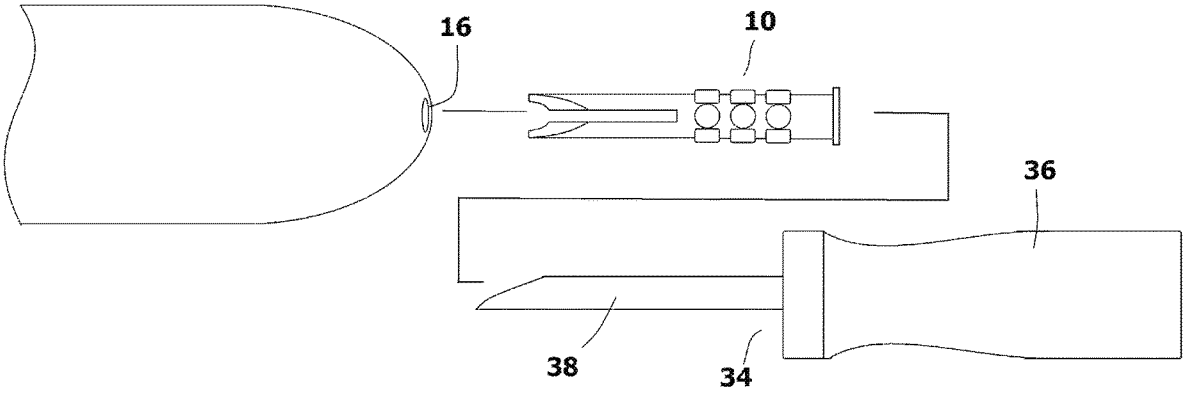
FIG. 3 shows the exemplary embodiment of FIG. 1 shown in conjunction with an insertion tool.

Referring to FIG. 3 in conjunction with FIG. 1 and FIG. 2, it can be seen that the insertion of the smoking stent device 10 can be assisted by the use of an insertion tool 34. The insertion tool 34 has a handle 36. A spike 38 protrudes from the handle 36. The spike 38 has a diameter that enables the spike 38 to pass inside the central conduit 24 of the smoking stent device 10 through the second end 22 of the smoking stent device 10. To use the insertion tool 34, the spike 38 is first used to create the small opening 16 in the end of a cigar 12. Once the small opening 16 is created, the spike 38 is pulled out of the cigar 12 and the smoking stent device 10 is advanced onto the spike 38. The spike 38, with the surrounding smoking stent device 10 is then reinserted into the small opening 16 previously made by the spike 38. The diameter of the small opening 16 is slightly smaller than that of the tubular body 18 of the smoking stent device 10. As such, the smoking stent device 10 is advanced into the cigar 12 with an interference fit. Due to the inference fit, once the spike 38 is pulled out of the cigar 12, the smoking stent device 10 remains in place. The result is the assembly of the cigar 12 and smoking stent device 10, such as is shown in FIG. 2.

Figure 4:
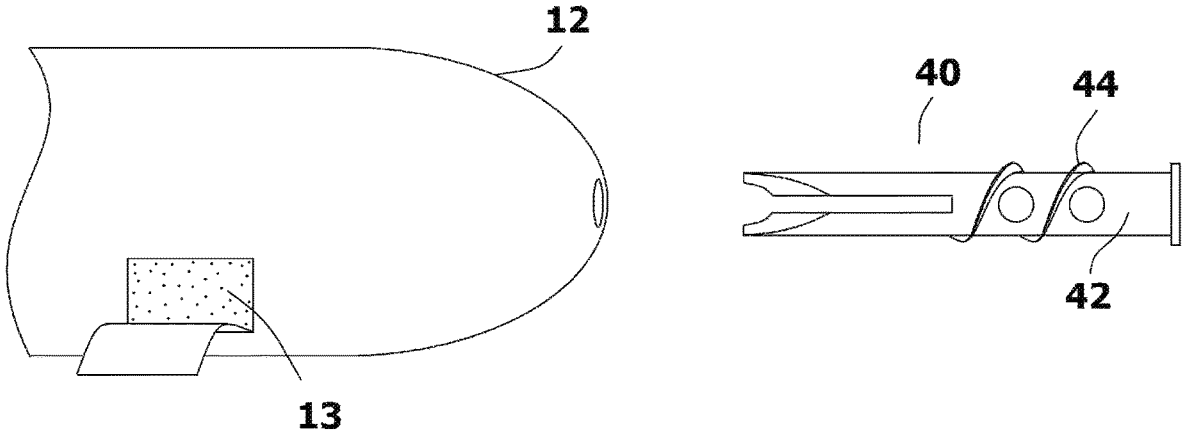
FIG. 4 shows a perspective view of a second exemplary embodiment of a stent device shown in conjunction with a cigar.

Referring to FIG. 4, an alternative embodiment is shown for the anchor system of a smoking stent device 40. In FIG. 4, the elongated body 42 of the smoking stent device 40 is provided with one or two external flights 44. The flights 44 thread into the tobacco fill 13 of the cigar 12 by slightly turning the smoking stent device 40 upon insertion.

Figure 5:
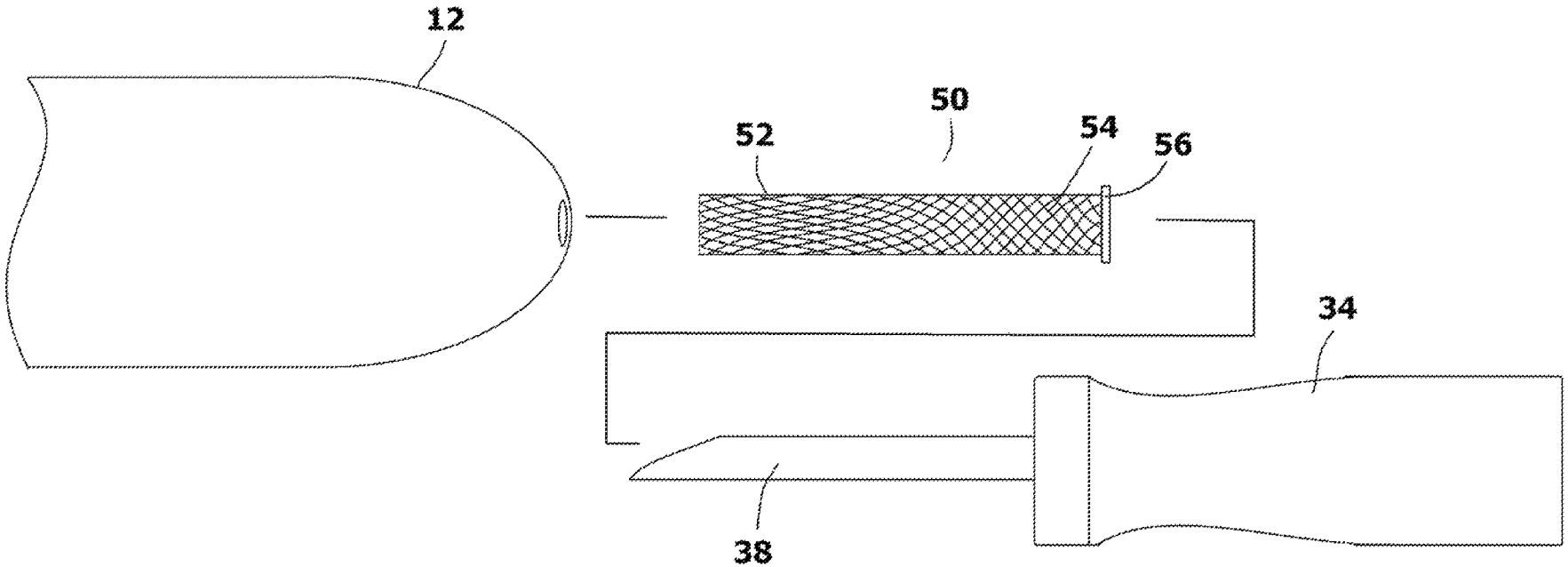
FIG. 5 shows a perspective view of a third exemplary embodiment of a stent device shown in conjunction with a cigar.

Referring to FIG. 5, another alternate embodiment of a smoking stent device 50 is shown. In this embodiment, the smoking stent device 50 is fabricated as a segment of a braided tube 52. The braided tube 52 is made from braided filaments 54. The end of the braided tube 52 is flared to create a stop 56. To utilize the smoking stent device 50, the insertion tool 34 that was previously described is used. To use the insertion tool 34, the spike 38 is first used to create the small opening 16 in the end of a cigar 12. Once the small opening 16 is created, the spike 38 is pulled out of the cigar 12 and the smoking stent device 50 is advanced onto the spike 38. The spike 38, with the surrounding smoking stent device 50 is then reinserted into the small opening 16 previously made by the spike 38. The spike 38 is withdrawn, leaving the smoking stent device 50 in the cigar 12.

Figure 6:
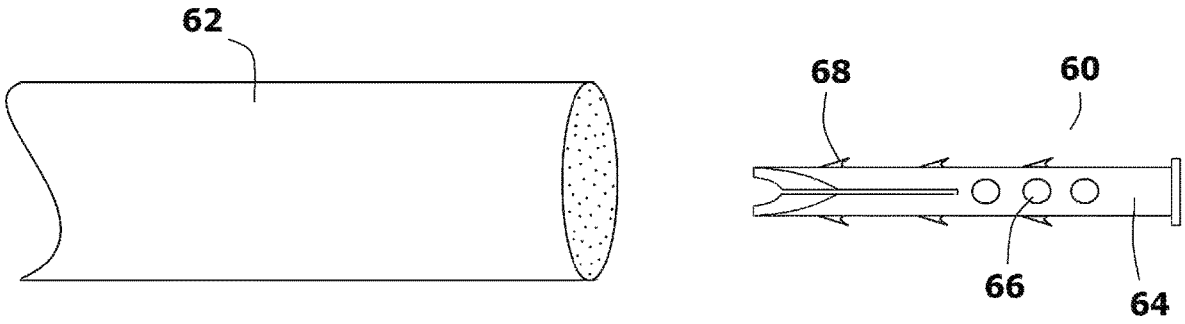
FIG. 6 shows a perspective view of a fourth exemplary embodiment of a stent device shown in conjunction with a cigarette.

Referring to FIG. 6, another embodiment of a smoking stent device 60 is shown for use on a cigarette 62. The smoking stent device 60 is narrower than other embodiments to facilitate use in a cigarette 62. The smoking stent device 60 has a tubular body 64 with smoke access openings 66. Small barbs 68 extend from the tubular body 64 to help lock the smoking stent device 60 in place within the cigarette 62.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A method of inserting a stent into a wrapped smoking product, comprising the steps of:

providing a wrapped smoking product having a fill material held within a wrapper, wherein said wrapped smoking product has an external diameter and one mouth end;

providing a stent device having a tubular body that extends between an open first end and an open second end, said tubular body defining a central conduit between said open first end and said open second end, wherein slots extend into said tubular body from said open first end and a plurality of openings are disposed along said tubular body between said slots and said open second end that provide access to said central conduit between said first end and said second end, and wherein a flange radially extends from said tubular body at said second end having a diameter that is smaller than said external diameter of said wrapped smoked product;

inserting said stent device into said mouth end of said wrapped smoking product so that said tubular body extends into said fill material and said flange at said second end of said stent device contacts said mouth end of said wrapped smoking product.

2. The method according to claim 1, further including forming a hole in said mouth end of said wrapped smoking product, wherein inserting said stent device into said mouth end of said wrapped smoking product includes inserting said stent device into said hole.

3. The method according to claim 2, further including providing a tool with a protruding spike, wherein forming said hole in said mouth end of said wrapped smoking product includes advancing said spike into said mouth end of said wrapped smoking product.

4. The method according to claim 3, wherein inserting said stent device into said mouth end of said wrapped smoking product includes placing said stent device on said spike and advancing said spike with said stent device into said hole.

5. The method according to claim 1, wherein providing a stent device includes providing a stent device with a taper at said first end, wherein inserting said stent device into said mouth end of said wrapped smoking product includes advancing said taper first into said wrapped smoking product.

6. The method according to claim 1, wherein providing a stent device includes providing a stent device with an anchoring system on an exterior surface thereof that causes said stent device to mechanically engage said fill material and inhibit said stent device from exiting said wrapped smoking product.

7. The method according to claim 6, wherein said anchoring system is selected from a group consisting of barbs, ridges and flights.

8. The method according to claim 1, wherein said tubular body is set into said fill material with an interference fit that inhibits said stent device from moving out of said wrapped smoking product.

9. The method according to claim 1, wherein said wrapped smoking product is selected from a group consisting of cigars and cigarettes.

10. The method according to claim 1, wherein said tubular body is a braided sleeve.

* * * * *